US007878781B2

(12) United States Patent
Elder

(10) Patent No.: US 7,878,781 B2
(45) Date of Patent: Feb. 1, 2011

(54) GEAR PUMP CAVITATION REDUCTION

(75) Inventor: James S. Elder, South Windsor, CT (US)

(73) Assignee: Hamilton Sundstrand Corporation, Rockford, IL (US)

( * ) Notice: Subject to any disclaimer, the term of this patent is extended or adjusted under 35 U.S.C. 154(b) by 556 days.

(21) Appl. No.: 12/001,279

(22) Filed: Dec. 11, 2007

(65) Prior Publication Data

US 2009/0148333 A1 Jun. 11, 2009

(51) Int. Cl.
*F01C 21/00* (2006.01)

(52) U.S. Cl. ..... 418/189; 418/206.1

(58) Field of Classification Search ..... 418/189, 418/206.1, 206.4
See application file for complete search history.

(56) References Cited

U.S. PATENT DOCUMENTS 3,833,317 A * 9/1974 Rumsey ..... 418/189
4,097,206 A * 6/1978 Schonherr ..... 418/189
4,290,739 A * 9/1981 Korse ..... 418/189
6,042,352 A 3/2000 Halter et al.
2006/0024188 A1* 2/2006 Muscarella et al. ..... 418/206.1
2007/0178003 A1* 8/2007 Zhu et al. ..... 418/206.1

* cited by examiner

*Primary Examiner*—Thomas E Denion
*Assistant Examiner*—Mary A Davis
(74) *Attorney, Agent, or Firm*—Kinney & Lange, P.A.

(57) ABSTRACT

A gear pump for operating with reduced likelihood of cavitation occurrences in the fluid being pumped thereby, the pump having a pair of gears each supported on a corresponding one of a pair of gear with teeth provided in each gear that mesh with at least one tooth of the other when such teeth have been rotated into a meshing region in the gear plane, and with one of the gear shafts being rotatably connectable to a motor. Bearing structures rotatably support corresponding ones of each of the pair of gear shafts with the bearing structures having bearing surfaces adjacent those gear sides. A pressurized fluid passageway is provided in at least one of the bearing structures across from the meshing region and extending between surface openings at the bearing surface of that bearing structure that are positioned on opposite sides of an alignment axis in that bearing surface, the surface openings being separated from one another by at least the width of a tooth provided in the pair of gears.

17 Claims, 7 Drawing Sheets

GEAR PUMP CAVITATION REDUCTION

BACKGROUND

The present invention relates to hydrostatic or positive displacement pumps and, more particularly, to external gear pumps.

Gear pumps have therein a pair of rotating gears with gear teeth that come into, and then leave, a meshing with those of the other. They thereby continually trap fluid portions at one location and displace those fluid portions to another location so, as a result, to effect a pumping of that fluid. The cross section side view schematic diagram of FIG. 1A shows an external gear pump, 1. Such a pump typically has two identical spur gears, 2 and 3, each with gear teeth arrayed about the outer periphery thereof and each mounted on, or integrally supported by, a corresponding one of a pair of gear shafts, 4 and 5, with these gears contained in a pump housing, 6. The teeth of these gears mesh with one another at a mesh location, 7, through having one or more gear teeth of one coming into, and leaving, mesh with one or more gear teeth of the other because of those gears being rotated in selected rotation directions by a selectively operated motor (not shown). When operated gear 2 is rotating clockwise, and so resulting in gear 3 rotating counterclockwise, pump 1 draws the fluid to be pumped through an inlet opening, 8, in housing 6, as indicated by the broad, flat arrow shown there, to be transported by rotating gears 2 and 3 along the interior of the walls of housing 6 at the outer periphery of those gears to an outlet opening, 9, in housing 6 at which the fluid exits the pump as indicated by the broad, flat arrow shown there.

FIG. 1B is a perspective schematic diagram providing more detail of the internal mechanisms of pump 1 through presenting same outside of housing 6. The figure shows a portion of a motor drive shaft, 10, extending from the unseen operating motor through the side of housing 6 to connect to gear shaft 4 (which alternatively may merely be extended to form drive shaft 10), as the basis for that motor to force rotation of gear 2 mounted on that shaft in the rotation direction selected therefor. Here, gear 2 is shown rotated in the clockwise direction to be consistent with the fluid flow direction along the primary paths of the fluid being pumped through its being transported from the intake side of pump 1 to the discharge side thereof which are shown by broad, flat arrows in FIG. 1B. This rotation of gear 2 in turn forces gear 3 on gear shaft 5, through the meshing of the two gears at mesh location 7, to also rotate but in the opposite rotation direction, or counterclockwise. Gear shafts 4 and 5, each extend at both of the opposite outer ends thereof into one of a corresponding pair of bearings, 11.

Each of bearings 11 comprises a ring-like structure that has a flat, but partially recessed, bearing surface, 11', facing the one of gears 2 and 3 it is supporting. Thus, such bearing surfaces extend substantially perpendicular to the direction of extent of the corresponding one of gear shafts 4 and 5 passing therethrough in their extending along the corresponding shaft axis of symmetry. Further, each of bearings 11 has a circular cross section bushing, 11", in the center of its ring-like structure which extends perpendicular to the bearing surface it intersects in being aligned with the symmetry axis of the gear shaft positioned therein.

Since the two ring-like structures of bearings 11 on the same side of each of the gears are closely adjacent to one another, they can be, and usually are, structurally or integrally joined together in a structure resembling a "figure 8" when viewed from a direction parallel to the axes of symmetry of the gear shafts when positioned therein. The pairs of bearings 11 at opposite ends of the gear shafts for each of the gears or, alternatively, the pair of "figure 8" structures 11 at the opposite ends of the gear shafts of both gears, are held in housing 6 so that this housing surrounds the gears and those bearings. As indicated above, gear shaft 4 is connectable to, or extendable as, motor drive shaft 10 in one or the other extending through the housing wall. When assembled in this housing, there is for the most part very little clearance between the flat parts of the bearing surfaces and the corresponding bearing surface side of the gear across therefrom to provide one basis for keeping the fluid being pumped from escaping out the sides of the gears.

At the intake side of pump 1, inlet opening 8 in the wall of pump housing 6 forms an inlet port at which fluid to be pumped is drawn to enter by gears 2 and 3 coming out of mesh at a location relatively near to this port. In coming out of mesh, an expanding inter-tooth volume forms between adjacent teeth on each gear as the formerly meshed tooth of the other gear exits those spaces. These inter-tooth volumes in the spaces between adjacent teeth on the gear coming out of mesh are filled by fluid from the input port and, as indicated above, forced to move with each gear between its teeth along the closely adjacent interior surface of the outer wall of the housing to outlet opening 9 at the discharge side of the pump. The very small clearances between the tips of the teeth on the gears and the corresponding housing wall interior surface, the speed of movement of the gear teeth tips along that surface, and the close proximity of the flat bearing surfaces to the sides of the gears, as described above, keep the fluid in the inter-tooth volumes trapped to prevent same from leaking backward towards the input port.

At the discharge side of the pump, outlet opening 9 in the wall of housing 6 forms an outlet port at which fluid is being forced to exit by gears 2 and 3 going into mesh at a location relatively near to this port to form shrinking inter-tooth volumes between those adjacent teeth on each gear resulting from corresponding teeth of the other gear entering those spaces. As a positive displacement pump, the fluid discharge pressure is predominantly determined by the downstream conduit passageway cross sectional areas. The meshing of the teeth of gears 2 and 3, at meshing location 7 which is more or less along an axis there joining the axes of symmetry of gear shafts 4 and 5, and the presence of closely adjacent flat bearing surface portions there, has the effect of isolating the fluid at the output port from that at the input port.

Cavitation can occur in external gear pumps on the intake side of the pump in a region, 12, in which the teeth of gears 2 and 3 separate in coming out of mesh with one another. In this region, as indicated above, the expanding inter-tooth volume between adjacent teeth on each gear, where a tooth of the other gear had just been and is exiting, must be filled by the fluid to be pumped that is coming in from inlet opening 8 under whatever is the inlet port fluid pressure. As the rotational speed of the gears increases to reach some threshold value the rate of the expanding inter-tooth volumes can exceed the rate such volumes can be filled by this incoming fluid at inlet port 8 under the inlet port fluid pressure. In these circumstances, the local fluid pressure decreases below the vapor pressures of dissolved gases in the fluid, or the vapor pressure of the pumped fluid itself, so as to rupture the continuity of the fluid at some particle or solid surface nucleation site and thereby form a cavity or bubble. Such gases, or the vapors of the fluid, or both, evaporate into that cavity from the surrounding fluid medium.

As the inter-tooth volumes subsequently become more filled, the rising local fluid pressure forces such cavities or bubbles toward collapse causing the pressure and the temperature of the vapors therein to increase. This continues until the volume of those cavities or bubbles become a very small fraction of their original sizes to finally reach a point of total collapse, and so to result in an acoustic shock wave occurring in a very small volume that dissipates the vapors into the surrounding fluid medium. Such collapses occurring on or near surfaces of the gear teeth can erode them to thereby leave pits at those surfaces which, in occurring repeatedly, can be very destructive of the gear teeth surfaces.

Because of occurrences of such unwanted cavitation, bearing surfaces 11' have often been recessed inward into the bearing to have those bearings be provided with channels, 11''' and 11'''' (not seen in FIG. 1B), therein that begin adjacent to location 7 where gears 2 and 3 mesh and, from there, extend along generally opposite directions. These opposite directions are both substantially perpendicular to an axis intersecting the axes of symmetry of shafts 4 and 5 positioned in cross section bushings 11", and the channels extend along these directions to corresponding ones of outer edge portions of bearing ring-like structures, or the "figure 8" structures, 11. At these outer edges, such channels may extend over a circular arc that is an eighth or more of the circular outer edge. Thus, there are two such channels, input channel 11''' and output channel 11'''' (not seen in FIG. 1B), each directed from a corresponding beginning location near location 7 and extending in opposite directions to each terminate at an outer edge of structure 11 near, respectively, a corresponding one of inlet 8 and outlet 9. Output channel 11'''' (not seen in FIG. 1B) accommodates the pumped fluid being squeezed out between the gear teeth coming into mesh near outlet 9, and input channel 11''' accommodates the pump incoming fluid rushing in between the gear teeth coming out of mesh near inlet 8.

Even with such accommodations, however, the rate at which the returning fluid fills the expanding inter-tooth volume depends on the fluid pressure at the inlet port. Hence, beyond some rotation rate, this fluid inter-tooth volume filling rate will be insufficient to keep up with the expanding inter-tooth volume rate so as to still result in cavitation occurring. Thus, there is a desire for a gear pump with an arrangement for reducing further, or eliminating, cavitation occurrences during operation thereof.

SUMMARY

The present invention provides a gear pump for operating with reduced likelihood of cavitation occurrences in the fluid being pumped thereby, the pump having a pair of gears each supported on a corresponding one of a pair of gear shafts between shaft ends thereof with each gear shaft having a corresponding gear shaft axis of symmetry intersecting the shaft ends thereof substantially parallel to one another, and each gear intersecting a common gear plane substantially perpendicular to the gear shaft axes of symmetry with teeth provided in each gear that mesh with at least one tooth of the other when such teeth have been rotated into a meshing region in the gear plane, and with one of the gear shafts being rotatably connectable to a motor. Bearing structures rotatably support corresponding ones of each of the pair of gear shafts on either side of that one of the pair of gears supported thereby, and with the bearing structures having bearing surfaces adjacent those gear sides. A pressurized fluid passageway is provided in at least one of the bearing structures across from the meshing region and extending between surface openings at the bearing surface of that bearing structure that are positioned on opposite sides of an alignment axis in that bearing surface extending between the gear shaft axes of symmetry, the surface openings being separated from one another by at least the width of a tooth provided in the pair of gears.

DETAILED DESCRIPTION

Figures 2A, 2B, 2C:
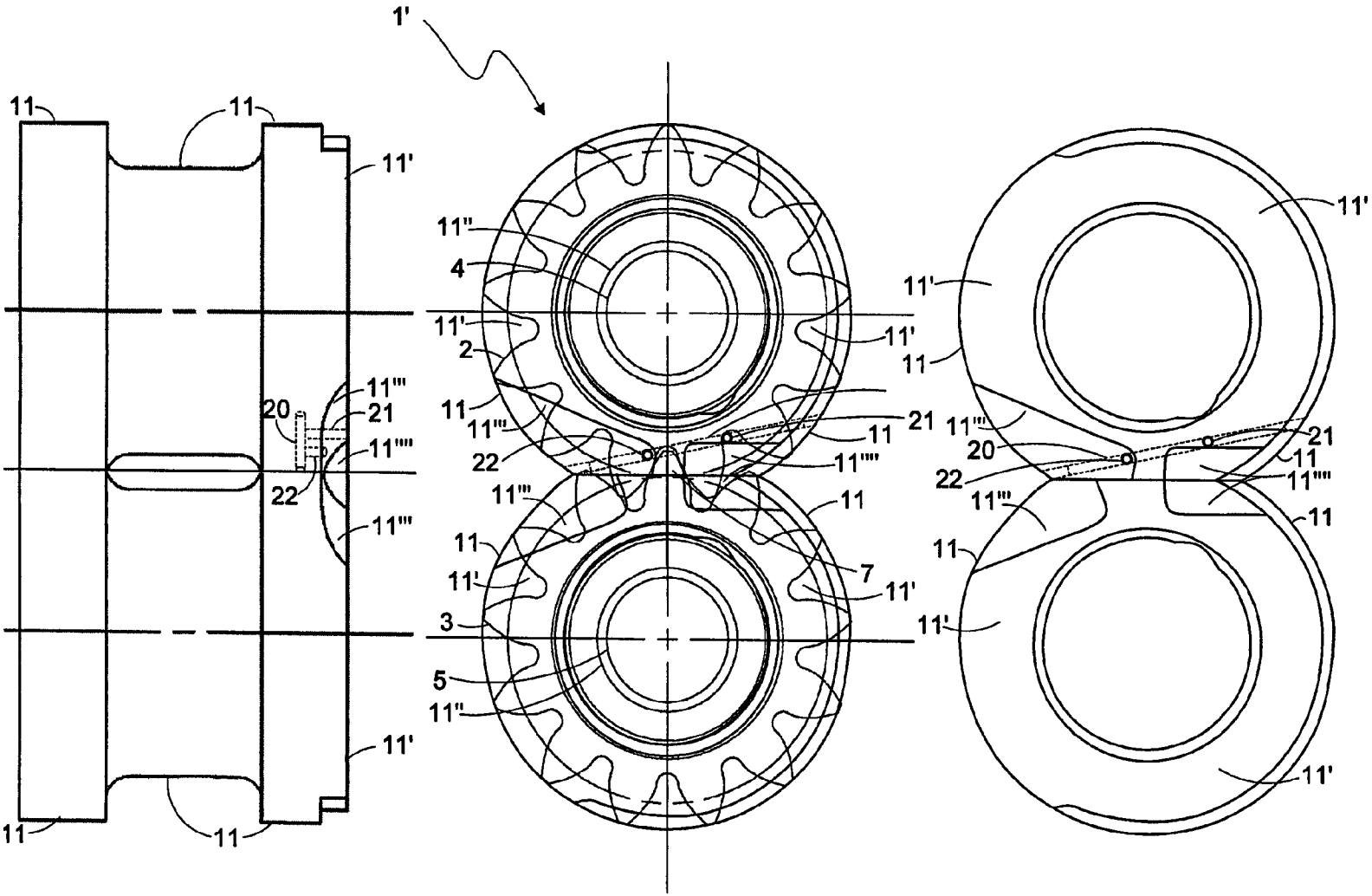
FIGS. 2A, 2B and 2C show side and front views of a portion of, and a side cross section view of, a gear pump of the present invention.

A modified gear pump 1' is shown in FIGS. 2A, 2B and 2C with a passageway, 20, extending between an outlet passageway port, 21, at bearing surface 11' near output channel 11'''', and an inlet passageway port, 22, in inlet channel 11''' of rear bearing 11. Rear bearing 11 is shown in a side view thereof in FIG. 2A and in a front view thereof in FIG. 2C, and this bearing is again shown behind gears 2 and 3 in the cross section view of gear pump 1' in FIG. 2B. Outlet passageway port 21 is located near outlet 9 but at bearing surface 11' just outside of output channel 11'''' so that pressurized fluid at the pump output is forced into that port and then through connected passageway 20 whenever a gear tooth on gear 2 is not over the port. The close spacing between the sides of gear 2 and bearing surface 11' results in the gear tooth essentially closing off outlet passageway port 21 when a gear tooth is over that port. Front bearing 11, on the opposite side of gears 2 and 3 from rear bearing 11 shown in FIGS. 2A, 2B and 2C, can also be configured to provide fluid under pressure to the inter-tooth volumes near what would otherwise be cavitation sites from the opposite side of these gears to thereby act to fill those volumes faster.

Figure 3:
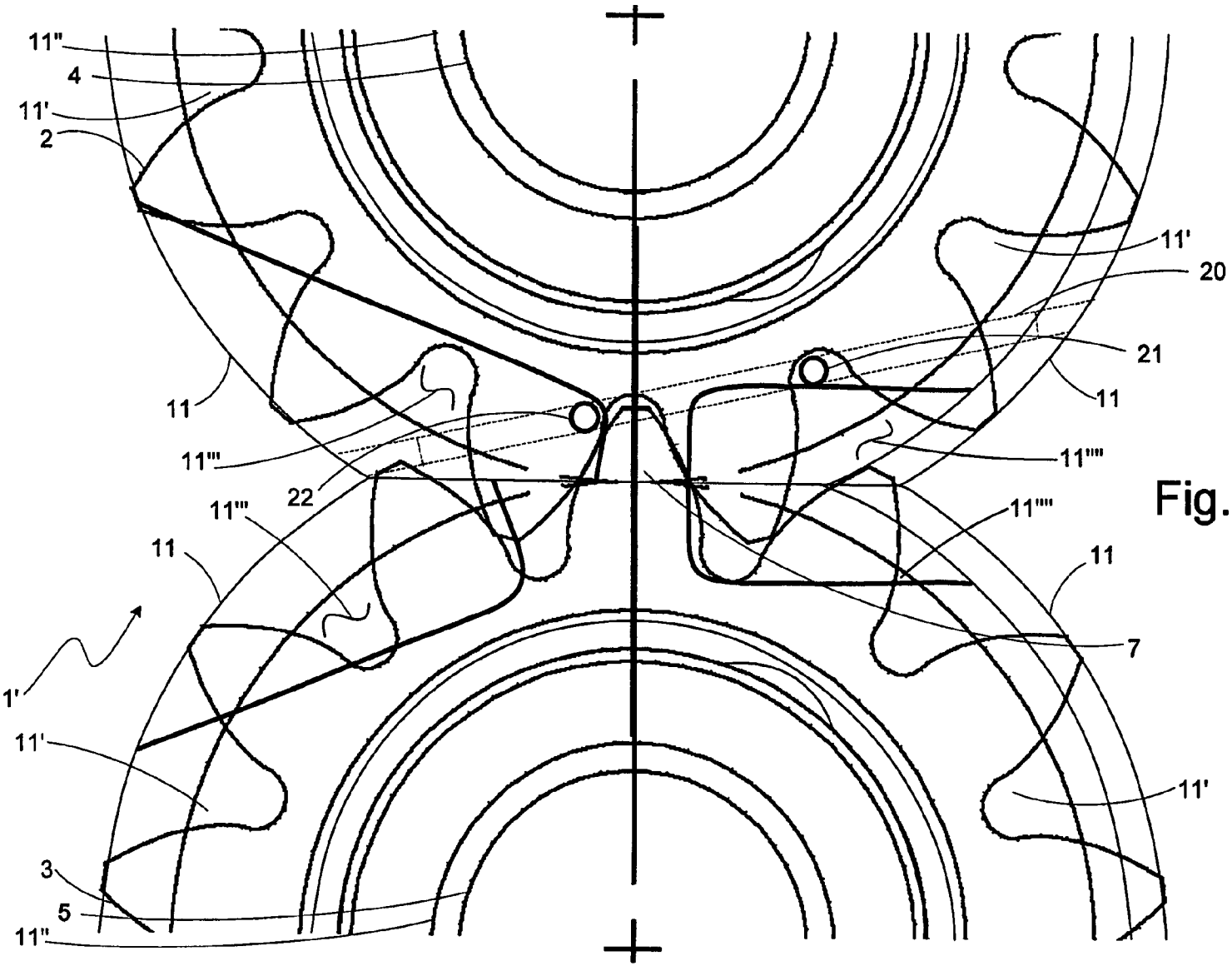
FIG. 3 shows a side cross section view of a portion of the gear pump shown in FIG. 2.

Thus, locating inlet passageway port 22 at a location in inlet channel 11''' near those locations where cavitation can otherwise be expected to occur allows the pressurized fluid in passageway 20 to be forced through connected inlet passageway port 22 into inlet channel 11''' near those cavitation associated locations just at those times the inter-tooth volume is beginning to increase because of the gear teeth there beginning to come out of mesh to thereby reduce or eliminate occurrences of cavitation events there. One such location for inlet passageway port 22 is shown in FIG. 2B to be in inlet channel 11''' near the roots of meshed gear teeth of gear 2 where it is positioned past meshing location 7 approximately a half the width of a gear tooth on gear 3 from the axis intersecting the axes of symmetry of shafts 4 and 5 as those shafts are positioned in cross section bushings 11" of bearings 11. This is shown in somewhat greater detail in the side cross section view in FIG. 3 of a portion of the gear pump shown in FIG. 2B. Pressurized fluid is forced out of inlet passageway port 22 into inlet channel 11''' and then into the sequence of inter-tooth volumes between the teeth of gear 2 that come adjacent thereto from each of which corresponding teeth of gear 3 are sequentially exiting. In doing so, this forced flow from inlet passageway port 22 into inlet channel 11''' entrains with it fluid flowing into inlet channel 11''' from inlet 8 to be forced therewith into the inter-tooth volumes.

During the time the teeth of gears 2 and 3 are coming into mesh until just before coming out of mesh, a gear tooth of gear 2 covers outlet passageway port 21 to prevent pressurized fluid from entering that port which would otherwise be forced to enter inlet channel 11''' without also acting to fill a rapidly increasing inter-tooth volume. To do so, outlet passageway port 21 is located near the roots of teeth on gear 2 and positioned behind a tooth on gear 2 going into mesh at meshing location 7 approximately the width of that gear tooth on gear 2 from the axis intersecting the axes of symmetry of shafts 4 and 5, as those shafts are positioned in cross section bushings 11" of bearings 11, plus half of the inter-tooth spacing of gear teeth on that gear. Such prevention of pressurized fluid at the pump output being forced into inlet channel 11''' to provide no useful effect increases the pumping efficiency of pump 1'. However, if desired or thought needed in some circumstances, inlet passageway port 22 can instead be located in output channel 11'''' to provide a continuous flow of pressurized fluid from the pump output through passageway 20 to enter inlet channel 11'''.

As can be seen in FIGS. 2A, 2B and 2C, passageway 20 is provided in bearing 11 extending along a chord of a circle about the outer periphery of the upper portion of bearing 11 in the "figure 8" configuration shown at an angle to the axis intersecting the axes of symmetry of shafts 4 and 5 as those shafts are positioned in cross section bushings 11" of bearings 11. This passageway extends parallel to bearing surface 11' but deep enough below that surface to be below the bottoms of inlet and outlet channels 11''' and 11''''.

This passageway is formed by a hole drilled through this portion of bearing 11 along the chord mentioned from one side of the bearing to the other. Outlet passageway port 21 is drilled as a blind hole to intersect the hole drilled for passageway 20 as is inlet passageway port 22. The opposite ends of the hole drilled for passageway 20 have plugs inserted therein short of reaching the corresponding one of the inlet and outlet passageway ports to thereby prevent pressurized fluid from being forced out of either of the ends of this passageway hole.

Figure 1A:
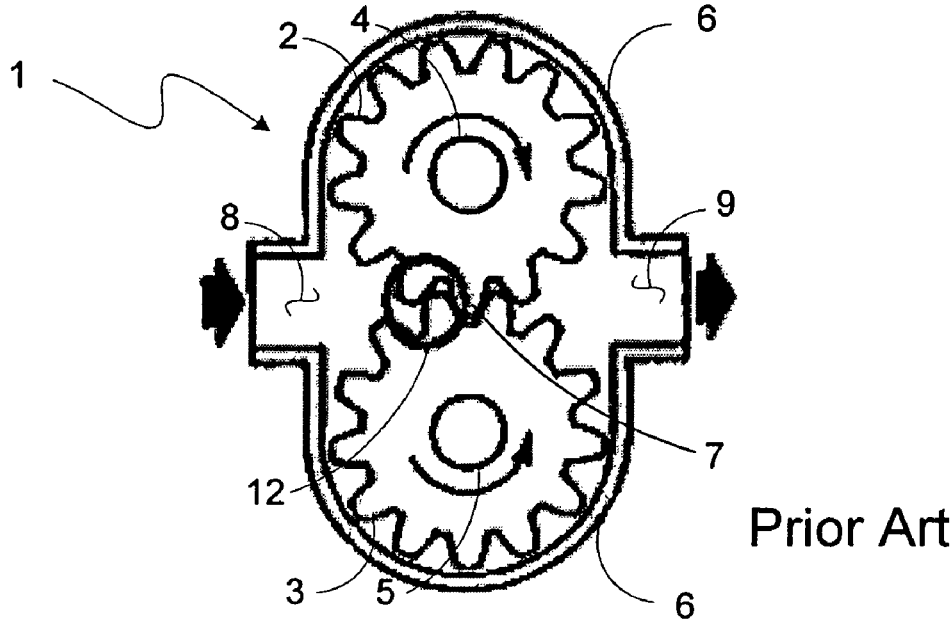
FIGS. 1A and 1B show side cross section and perspective unhoused views, respectively, of a gear pump.
Figure 1B:
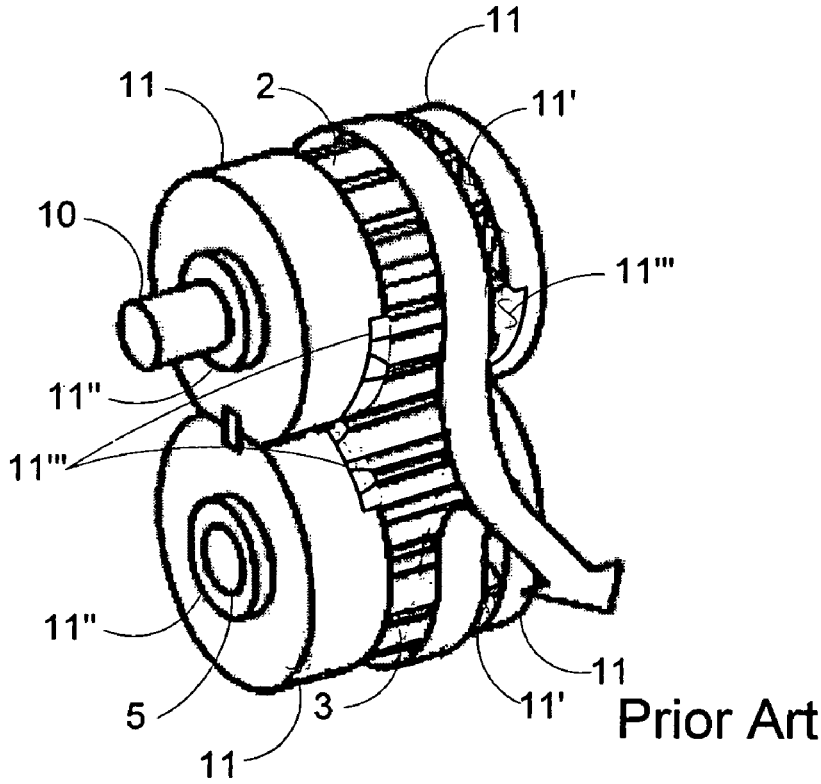
Figure 4:
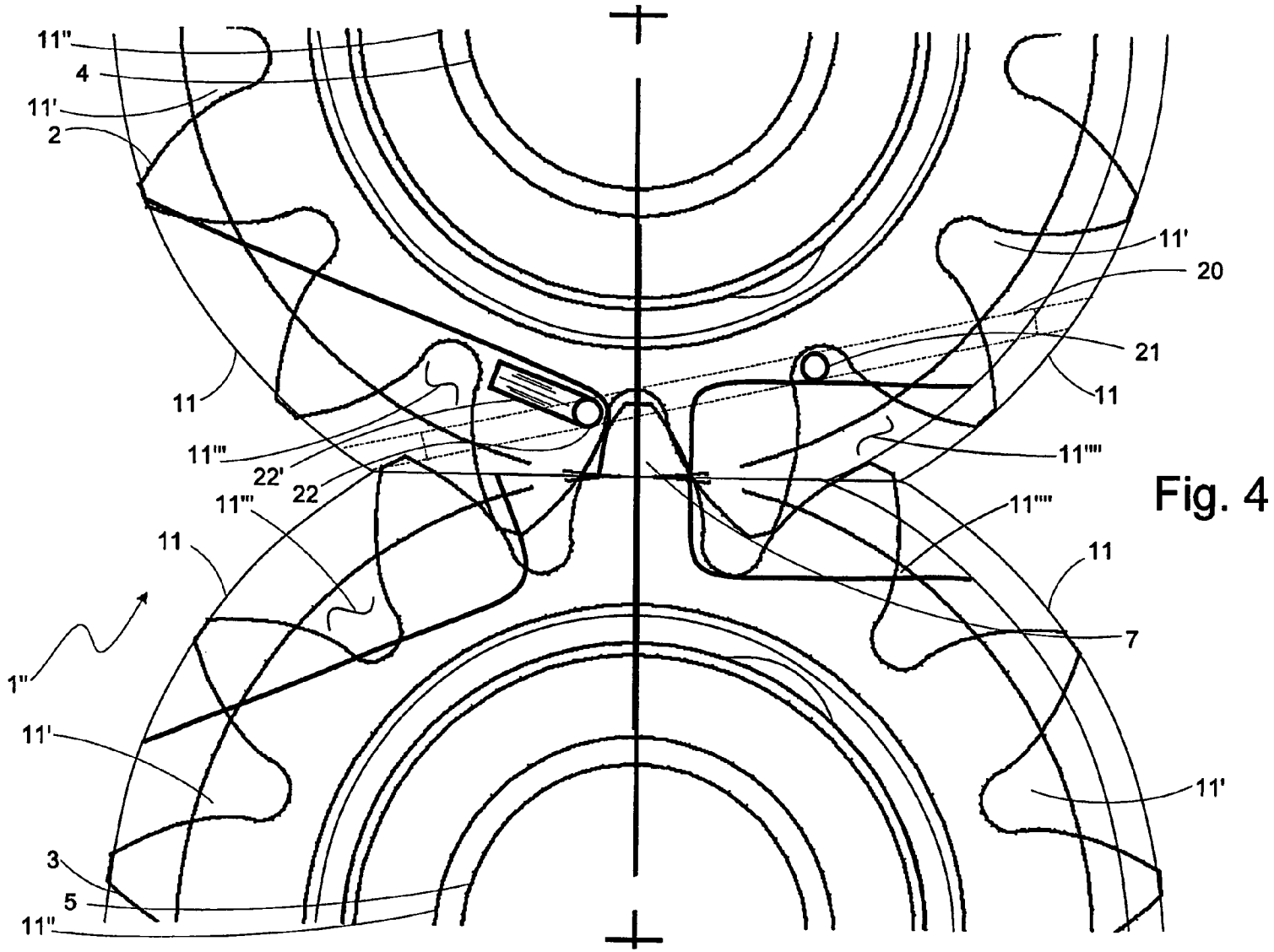
FIG. 4 shows a side cross section view of a portion of a gear pump of another embodiment of the present invention.

Cavitation can occur in more than one location near inlet 8 in the pump of FIG. 1. Thus, there may be a need to provide more than one inlet passageway port from which pressurized fluid from the outlet region in pump 1' can be forced into inlet channel 11''' to fill the increasing inter-tooth volume. Thus, in FIG. 4, a side cross section view is shown of a further pump 1" modified from pump 1' in FIG. 3 by adding a slot, 22', in the bottom of inlet channel 11''' extending along that bottom from inlet passageway port 22 to aid in filling the the sequence of adjacent inter-tooth volumes.

Figure 5:
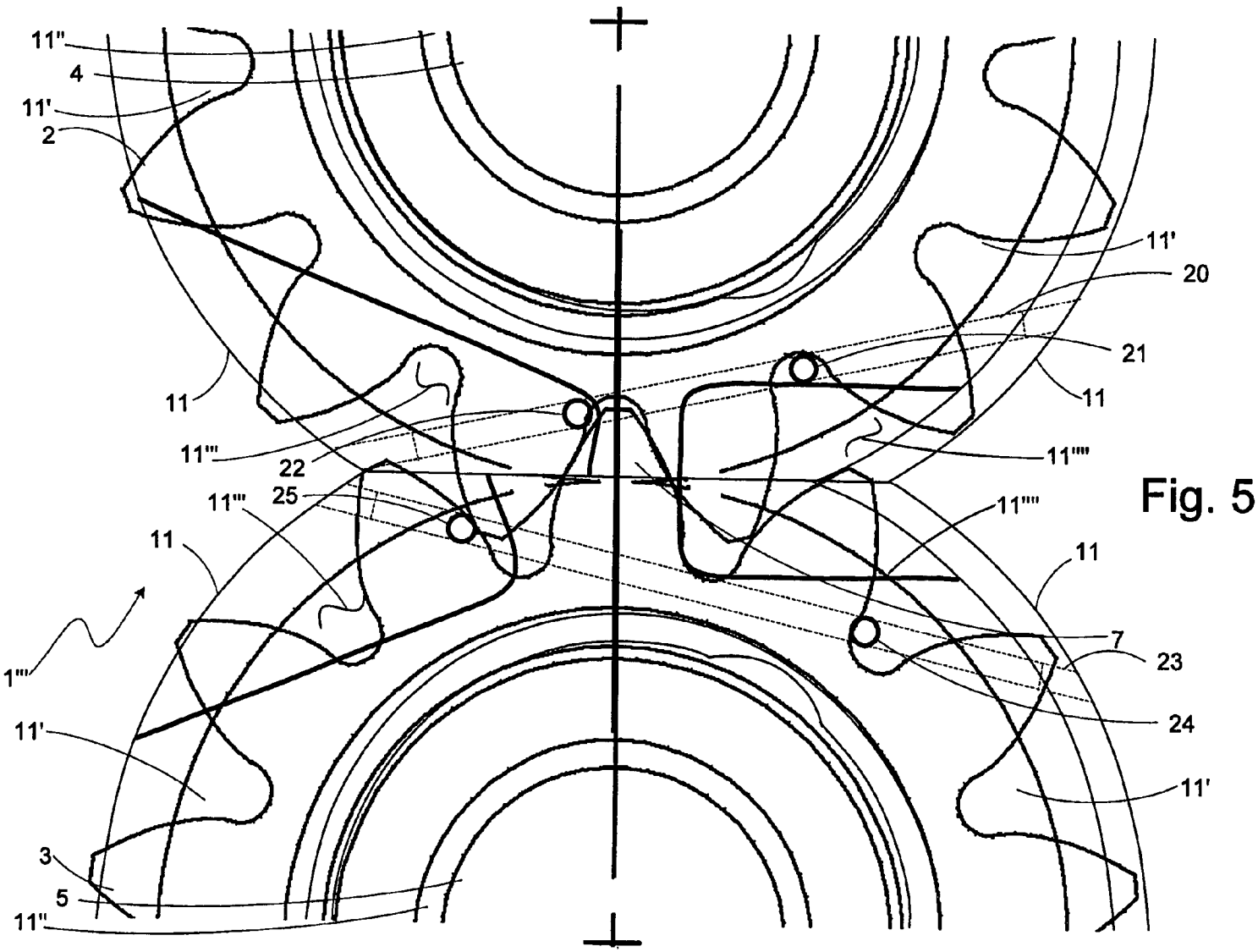
FIG. 5 shows a side cross section view of a portion of a gear pump of another embodiment of the present invention.

Another place that cavitation can occur is where the sequence of inter-tooth volumes between the teeth of gear 3 each have corresponding teeth of gear 2 sequentially exiting. Thus, a side cross section view is shown in FIG. 5 of a further pump 1''' modified from pump 1' in FIG. 3 in which a second passageway, 23, is provided along a chord of a circle about the outer periphery of the lower portion of bearing 11 in the "figure 8" configuration shown, again at an angle to the axis intersecting the axes of symmetry of shafts 4 and 5 as those shafts are positioned in cross section bushings 11" of bearings 11. Passageway 23 extends between an outlet passageway port, 24, at another part of bearing surface 11' near output channel 11'''', and an inlet passageway port, 25, at another part of inlet channel 11''' of rear bearing 11. Here, too, this passageway extends parallel to bearing surface 11' but deep enough below that surface to be below the bottoms of inlet and outlet channels 11''' and 11''''.

Here, inlet passageway port 25 is located in inlet channel 11''' adjacent to where the sequence of inter-tooth volumes between the teeth of gear 3 each have corresponding teeth of gear 2 sequentially exiting. This allows pressurized fluid in passageway 23 to be forced through connected inlet passageway port 25 into inlet channel 11''' just at those times the inter-tooth volume is beginning to increase because of the gear teeth there beginning to come out of mesh to thereby reduce or eliminate occurrences of cavitation events there because of gear teeth on gear 3 uncovering then outlet passageway port 24. The location shown in FIG. 5 for inlet passageway port 25 is in inlet channel 11''' near the roots of the first unmeshing gear tooth ahead of the currently meshed gear tooth of gear 3 at meshing location 7 where it is positioned approximately half of the width of a gear tooth on gear 3 from the axis intersecting the axes of symmetry of shafts 4 and 5, as those shafts are positioned in cross section bushings 11" of bearings 11, plus the inter-tooth spacing of gear teeth on that gear. Pressurized fluid is forced out of inlet passageway port 25 into inlet channel 11''' and then into the sequence of inter-tooth volumes between the teeth of gear 3 that come adjacent thereto from each of which corresponding teeth of gear 2 are sequentially exiting. This forced flow from inlet passageway port 25 into inlet channel 11''' entrains with it fluid flowing into inlet channel 11''' from inlet 8 to be forced therewith into the inter-tooth volumes.

Again, during the time the teeth of gears 2 and 3 are coming into mesh until just before coming out of mesh, a gear tooth of gear 2 covers outlet passageway port 24 to prevent pressurized fluid from entering that port which would otherwise be forced to enter inlet channel 11''' without also acting to fill a rapidly increasing inter-tooth volume. To do so, outlet passageway port 24 is located near the roots of teeth on gear 3 and positioned behind a tooth on gear 3 going into mesh at meshing location 7 approximately the width of one and a half gear teeth on gear 3 from the axis intersecting the axes of symmetry of shafts 4 and 5, as those shafts are positioned in cross section bushings 11" of bearings 11, plus the inter-tooth spacing of gear teeth on that gear. Such prevention of pressurized fluid at the pump output being forced into inlet channel 11''' to provide no useful effect increases the pumping efficiency of pump 1'''.

Figure 6:
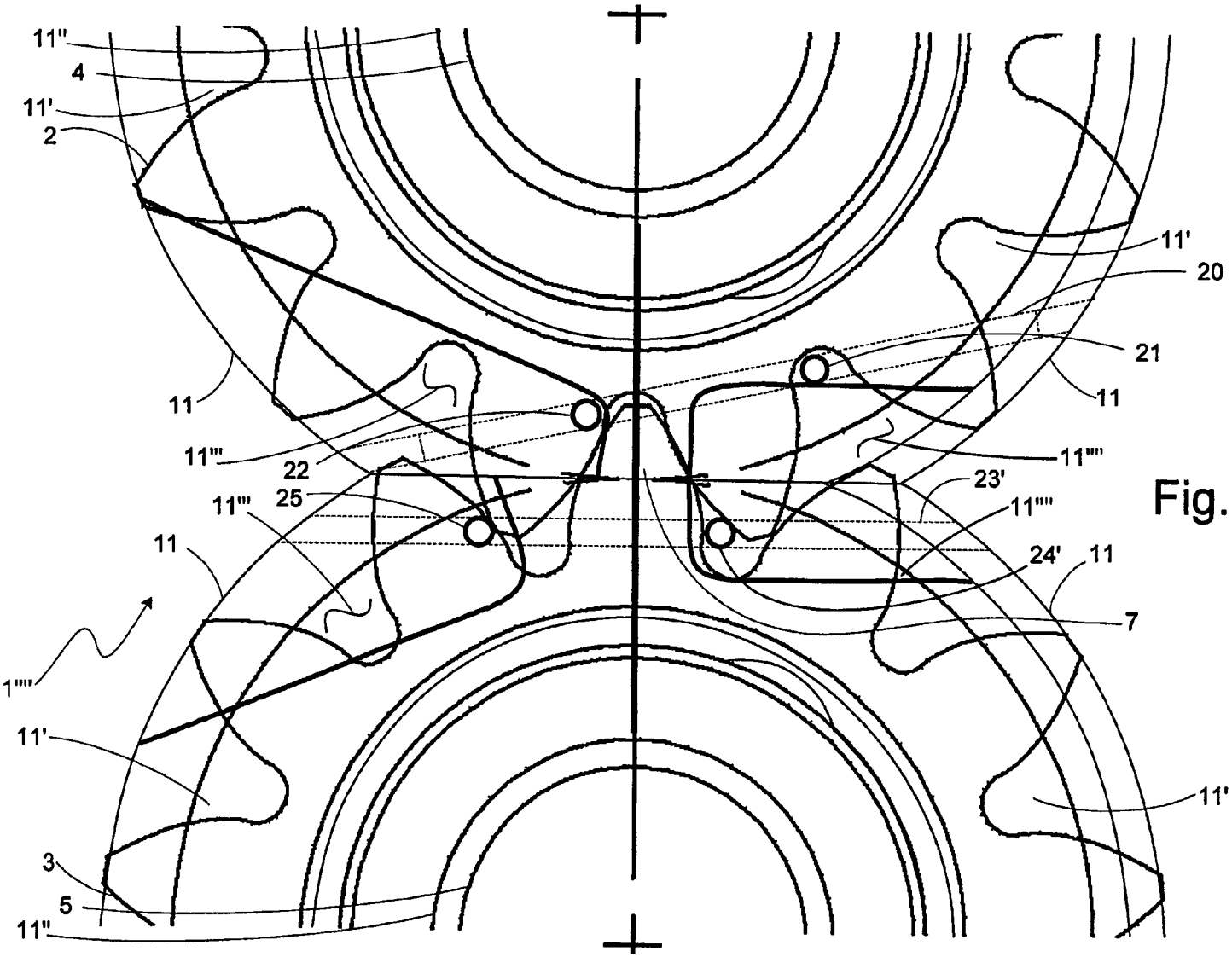
FIG. 6 shows a side cross section view of a portion of a gear pump of another embodiment of the present invention.

Again, if desired or thought needed in some circumstances, the inlet passageway port can instead be located in output channel 11'''' to thereby provide a continuous flow of pressurized fluid from the pump output through the second passageway to enter inlet channel 11'''. Thus, a side cross section view is shown in FIG. 6 of another pump 1'''' modified from pump 1''' in FIG. 5. Pump 1'''' is shown there with a second passageway, 23', that extends along a chord of a circle about the outer periphery of the lower portion of bearing 11 in the "figure 8" configuration shown, perpendicular to the axis intersecting the axes of symmetry of shafts 4 and 5 as those shafts are positioned in cross section bushings 11" of bearings 11. Passageway 23' is shown extending from inlet passageway port 25 in inlet channel 11''', as in FIG. 5, to a relocated outlet passageway port, 24', in outlet channel 11'''' shown in FIG. 6 for this continuous flow purpose. Outlet passageway port 24' is located near the roots of teeth on gear 3 and positioned behind a tooth on gear 3 going into mesh at meshing location 7 approximately the width of half a gear tooth on gear 3 from the axis intersecting the axes of symmetry of shafts 4 and 5, as those shafts are positioned in cross section bushings 11" of bearings 11.

Figure 7:
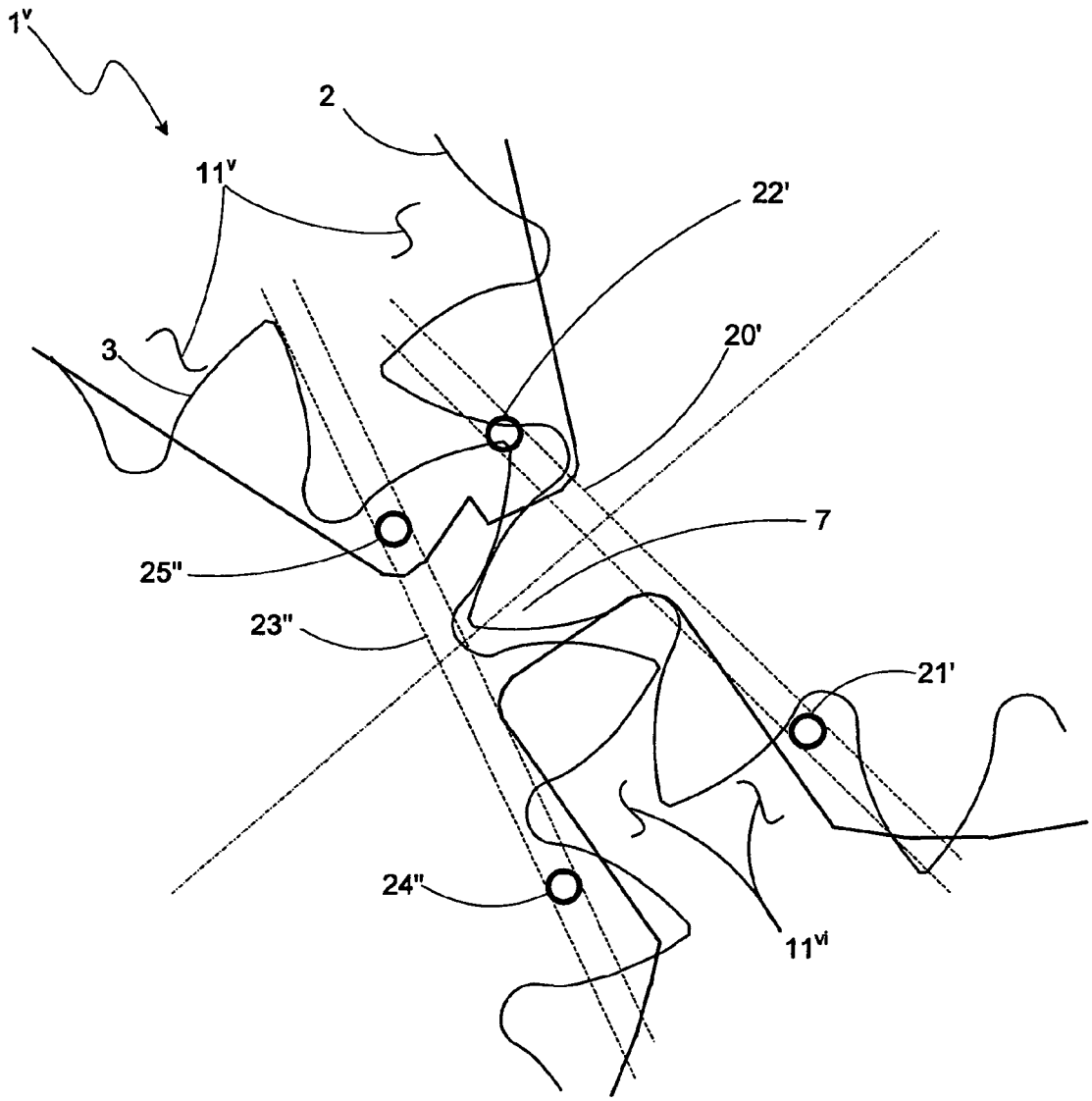
FIG. 7 shows a side cross section view of a portion of a gear pump of another embodiment of the present invention.

The configuration chosen for gears 2 and 3, and the configuration chosen for both inlet channel 11''' and outlet channel 11'''' determine to a substantial extent the useable locations for the inlet and outlet passageway ports and the passageways therebetween. The side cross section view shown in FIG. 7 is a limited representation of another pump 1$^{v}$ modified from pump 1''' in FIG. 5 with differently shaped and positioned inlet and outlet channels, 11$^{v}$ and 11$^{vi}$, respectively, from those shown in FIG. 5. This leads in turn to some differences in positioning of the inlet and outlet passageway ports and the passageways therebetween ranging from slight to significant, and so redesignated passageways, 20' and 23", are indicated in the figure. The former of these passageways extends between a redesignated outlet passageway port, 21', and a redesignated inlet passageway port, 22', and passageway 23" extends between a redesignated between a redesignated outlet passageway port, 24", and a redesignated inlet passageway port, 25".

Although the present invention has been described with reference to preferred embodiments, workers skilled in the art will recognize that changes may be made in form and detail without departing from the spirit and scope of the invention.

The invention claimed is:

1. A gear pump for operating with reduced likelihood of cavitation occurrences in the fluid being pumped thereby, the pump comprising:

a pair of gears each supported on a corresponding one of a pair of gear shafts between shaft ends thereof with each gear shaft having a corresponding gear shaft axis of symmetry intersecting the shaft ends thereof substantially parallel to one another, and each gear intersecting a common gear plane substantially perpendicular to the gear shaft axes of symmetry with spaced apart teeth provided in each gear that mesh with at least one tooth of the other when such teeth have been rotated into a meshing region in the common gear plane, and with one of the gear shafts being rotatably connectable to a motor;

bearing structures rotatably supporting corresponding ones of each of the pair of gear shafts on either side of that one of the pair of gears supported thereby, and with the bearing structures having bearing surfaces adjacent those gear sides each primarily in a corresponding bearing plane, the bearing surface of the bearing structure on at least one side of the pair of gears having an entry mesh recess across from where the pair of gears rotate to enter the meshing region and an exit mesh recess across from where the pair of gears rotate to exit the meshing region with the entry and exit mesh recesses each beginning at a corresponding beginning location separated from one another by a separation space that is intersected by an alignment axis in the bearing plane thereof intersecting the gear shaft axes of symmetry and from there each of the entry and exit mesh recesses extend in opposite directions at least in part perpendicular to that bearing plane axis; and a pressurized fluid passageway in at least one of the bearing structures across from the meshing region and extending between surface openings at the bearing surface of that bearing structure that are positioned on opposite sides of the alignment axis across from paths followed by the teeth of the pair of gears during rotations thereof, and with one of the surface openings being positioned in the exit mesh recess to have a concurrent flow of the fluid through both surface openings when the remaining surface opening is across from a space between successive ones of the gear teeth of one of the pair of gears.

2. The pump of claim 1 wherein each gear tooth of either of the pair of gears, in rotating to a position symmetrically about a coupling axis in the common gear plane extending between the gear shaft axes of symmetry to thereby reach a full mesh position, has a plane intersecting it which also extends substantially perpendicular to the bearing surface at which the surface openings occur and which intersects those surface openings, the plane being closer to a root of each such gear tooth than a point of contact thereof with a gear tooth of the other one of the pair of gears.

3. The pump of claim 1 wherein each gear tooth of either of the pair of gears, in rotating to a position symmetrically about a coupling axis in the common gear plane extending between the gear shaft axes of symmetry to thereby reach a full mesh position, has a plane intersecting it which also extends substantially perpendicular to the bearing surface at which the surface openings occur and which intersects those surface openings, the plane being closer to a point of contact of each such gear tooth with a gear tooth of the other one of the pair of gears than to a root of that gear tooth.

4. The pump of claim 1 wherein each gear tooth of either of the pair of gears, in rotating to a position symmetrically about a coupling axis in the common gear plane extending between the gear shaft axes of symmetry to thereby reach a full mesh position, thereby positions that tooth and the following gear tooth on the same one of the pair of gears between the surface openings.

5. The pump of claim 4 wherein each gear tooth of either of the pair of gears, in reaching the full mesh position, has a plane intersecting it which also extends substantially perpendicular to the bearing surface at the alignment axis and which intersects those surface openings, the plane being closer to a root of that gear tooth than the point of contact thereof with a gear tooth of the other one of the pair of gears.

6. The pump of claim 4 wherein each gear tooth of either of the pair of gears, in reaching the full mesh position, has a plane intersecting it which also extends substantially perpendicular to the bearing surface at the alignment axis and which intersects those surface openings, the plane being closer to a point of contact of that gear tooth with a gear tooth of the other one of the pair of gears than to a root of that gear tooth.

7. The pump of claim 4 wherein the pressurized fluid passageway in one of the bearing structures is a first pressurized fluid passageway extending between a first pair of surface openings at the bearing surface of that bearing structure, and further comprising a second pressurized fluid passageway in that bearing structure across from where gear teeth of the other of the pair of gears, under rotation, reach the full mesh position and extending between a second pair of surface openings at the bearing surface of that bearing structure which second pair of surface openings are across from the meshing region on either side of the width thereof.

8. The pump of claim 4 wherein the pressurized fluid passageway in one of the bearing structures is a first pressurized fluid passageway extending between a first pair of surface openings in a first bearing structure, and further comprising a second pressurized fluid passageway in a second bearing structure across from where gear teeth of the other of the pair of gears, under rotation, reach the full mesh position and extending between a second pair of surface openings at the bearing surface of that second bearing structure which second pair of surface openings are across from the meshing region on either side of the width thereof.

9. The pump of claim 4 wherein the pressurized fluid passageway in one of the bearing structures is a first pressurized fluid passageway extending between a first pair of surface openings in a first bearing, and further comprising a second pressurized fluid passageway in a second bearing structure on the opposite side of the one of the pair of gears from the first bearing structure and across from where gear teeth of the one of the pair of gears, under rotation, reach the full mesh position and extending between a second pair of surface openings at the bearing surface of that second bearing structure which second pair of surface openings are across from the meshing region on either side of the width thereof.

10. The pump of claim 1 wherein the remaining one of the surface openings is positioned in the entry mesh recess to have a concurrent flow of the fluid through both surface openings.

11. The pump of claim 1 wherein the pressurized fluid passageway in one of the bearing structures is a first pressurized fluid passageway extending between a first pair of surface openings at the bearing surface of that bearing structure, and further comprising a second pressurized fluid passageway in that bearing structure across from where gear teeth of the other of the pair of gears, under rotation, reach the full mesh position and extending between a second pair of surface openings at the bearing surface of that bearing structure which second pair of surface openings are across from the meshing region on either side of a width thereof.

12. The pump of claim 1 wherein the pressurized fluid passageway in one of the bearing structures is a first pressurized fluid passageway extending between a first pair of surface openings in a first bearing structure, and further comprising a second pressurized fluid passageway in a second bearing structure across from where gear teeth of the other of the pair of gears, under rotation, reach the full mesh position and extending between a second pair of surface openings at the bearing surface of that second bearing structure which second pair of surface openings are across from the meshing region on either side of a width thereof.

13. The pump of claim 1 wherein the pressurized fluid passageway in one of the bearing structures is a first pressurized fluid passageway extending between a first pair of surface openings in a first bearing, and further comprising a second pressurized fluid passageway in a second bearing structure on the opposite side of the one of the pair of gears from the first bearing structure and across from where gear teeth of the one of the pair of gears, under rotation, reach the full mesh position and extending between a second pair of surface openings at the bearing surface of that second bearing structure which second pair of surface openings are across from the meshing region on either side of a width thereof.

14. A gear pump bearing structure having an opening therein for rotatably supporting a gear shaft at a side of a gear mounted on that shaft with the bearing structure having a bearing surface that would be adjacent to a side of such a gear with its shaft so supported that has recesses therein beginning at locations separated from one another by a separation space but near to a position on a path that would be traversed by teeth of such a gear during rotations thereof with these recesses from these separated beginning locations extending in opposite directions at least in part tangential to such a path to form a pair of recessed surface portions in the bearing surface, and further having a pressurized fluid passageway therein positioned to be across from the position that would be traversed by teeth of that gear during rotations thereof so as to extend between surface openings at the bearing surface of that bearing structure that are positioned on opposite sides of the separation space in that bearing surface with one of the surface openings positioned in the recess across from the position on the path that would be traversed by teeth of the gear during rotation thereof upon leaving a position across from the separation space.

15. The pump of claim 14 wherein another of the surface openings is positioned in the recess across from the position on the path that would be traversed by teeth of the gear during rotation thereof approaching a position across from the separation space.

16. A gear pump for operating with reduced likelihood of cavitation occurrences in the fluid being pumped thereby, the pump comprising:

a pair of gears each supported on a corresponding one of a pair of gear shafts between shaft ends thereof with one of the gear shafts being rotatably connectable to a motor;

bearing structures rotatably supporting corresponding ones of each of the pair of gear shafts on either side of that one of the pair of gears supported thereby, and with the bearing structures having bearing surfaces adjacent those gear sides with at least one of those bearing surfaces having recesses therein beginning at locations separated from one another by a separation space but near to a position on paths that would be traversed by teeth of the pair of gears during rotations thereof with these recesses from these separated beginning locations extending in opposite directions at least in part tangential to such paths to form a pair of recessed surface portions in the bearing surfaces; and a pressurized fluid passageway in at least one of the bearing structures positioned to be across from the position that would be traversed by teeth of the pair of gears during rotations thereof so as to extend between surface openings at the bearing surface of that bearing structure that are positioned on opposite sides of the separation space in that bearing surface with one of the surface openings positioned in the recess across from the position on the path that would be traversed by teeth of the gear during rotation thereof upon leaving a position across from the separation space.

17. The pump of claim 16 wherein another of the surface openings is positioned in the recess across from the position on the path that would be traversed by teeth of the gear during rotation thereof approaching a position across from the separation space.

* * * * *